US005889361A

United States Patent [19]

Wang et al.

[11] Patent Number: 5,889,361

[45] Date of Patent: Mar. 30, 1999

[54] UNIFORM FIELD EMISSION DEVICE

[75] Inventors: Wen Chun Wang, Hsinchu; Jermmy J. M. Wang, Kaohsyung; Tzung-Zu Yang, Hsinchu, all of Taiwan

[73] Assignee: Industrial Technology Research Institute, Hsin-Chu, Taiwan

[21] Appl. No.: 92,884

[22] Filed: Jun. 8, 1998

Related U.S. Application Data

[62] Division of Ser. No. 668,985, Jun. 21, 1996, Pat. No. 5,791,961.

[51] Int. Cl.[6] ..... H01J 9/02; H01J 1/30

[52] U.S. Cl. ..... 313/336; 313/309; 445/50

[58] Field of Search ..... 313/336, 309, 313/351, 495; 445/24, 50

[56] References Cited

U.S. PATENT DOCUMENTS

| | | | |
|---|---|---|---|
| 5,194,780 | 3/1993 | Meyer | 315/169.3 |
| 5,283,500 | 2/1994 | Kochanski | 315/58 |
| 5,396,150 | 3/1995 | Wu et al. | 313/309 |
| 5,507,676 | 4/1996 | Taylor et al. | 445/24 |
| 5,522,751 | 6/1996 | Taylor et al. | 445/24 |
| 5,556,316 | 9/1996 | Taylor et al. | 445/50 |
| 5,631,518 | 5/1997 | Baker | 445/24 |

*Primary Examiner*—Sandra O'Shea
*Assistant Examiner*—Joseph Williams
*Attorney, Agent, or Firm*—George O. Saile; Stephen B. Ackerman

[57] ABSTRACT

A cold cathode field emission device is described. A key feature of its design is that groups of microtips share a single conductive disk with a reliable ballast resistor being interposed between each of these conductive disks and the cathode conductor. Additionally, a resistor, rather than a conductor, is used to connect the gate conductive disk to the gate electrode. The latter is arranged so as not to overlap with the cathode electrode. The cathode and gate conductive disks ensure that the ballast resistance associated with each microtip is essentially the same.

12 Claims, 3 Drawing Sheets

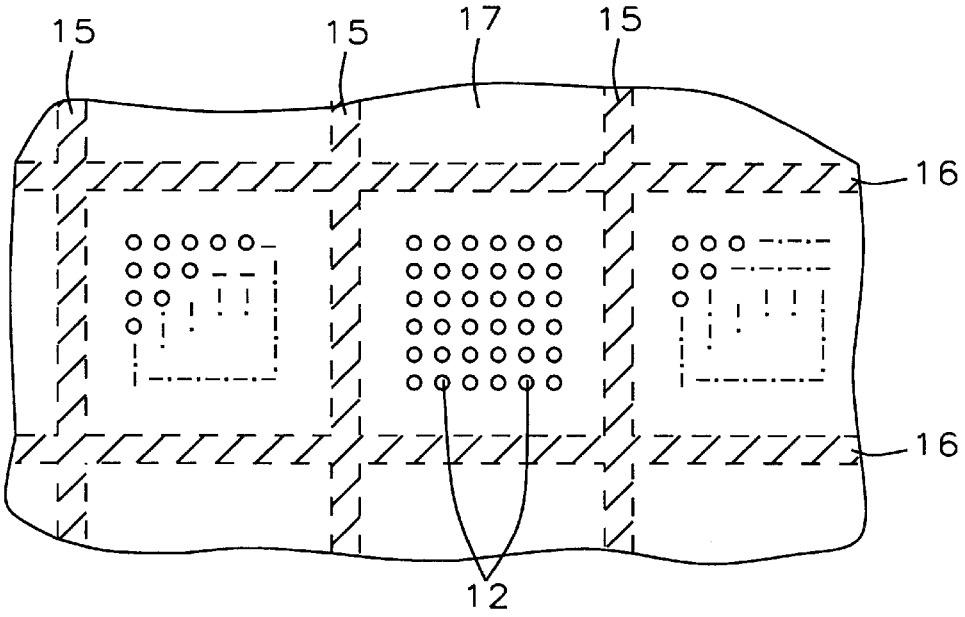
FIG. 1 – Prior Art
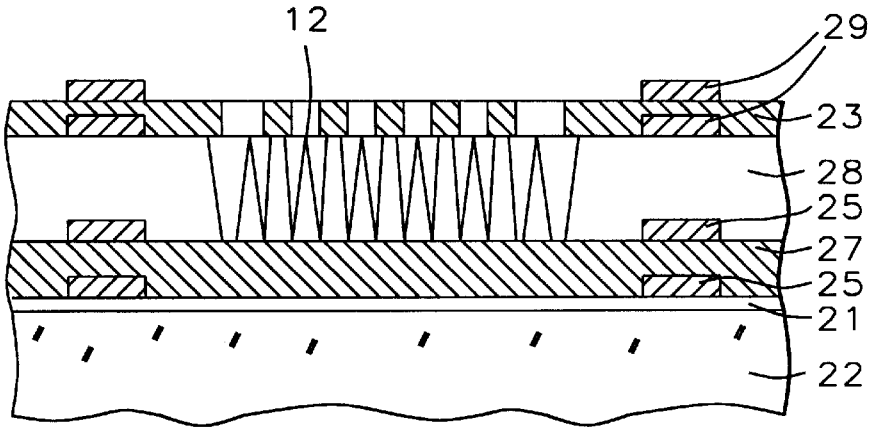
FIG. 2 – Prior Art

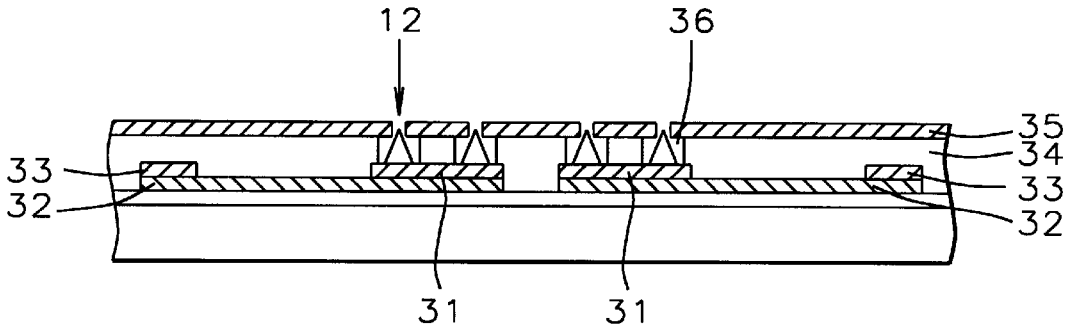
FIG. 3 – Prior Art
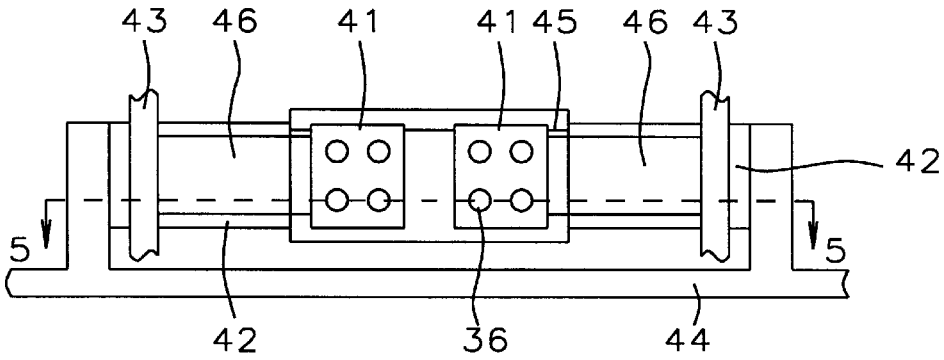
FIG. 4

UNIFORM FIELD EMISSION DEVICE

This is a division of patent application Ser. No. 08/668,985, filing date Jun. 21, 1996 U.S. Pat. No. 5,791,961, Uniform Field Emission Device, assigned to the same assignee as the present invention.

BACKGROUND OF THE INVENTION (1) Field of the Invention

The invention relates to cold cathode field emission devices and displays.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines at an angle (usually 90°) to them, intersecting with them at the locations of the conical emitters or microtips, and connected to a source of relatively positive voltage.

The electrons that are emitted by the cold cathodes accelerate past openings in the gate lines and strike an electroluminescent panel that is located some distance above the gate lines. Thus, one or more microtips serves as a sub-pixel for the total display. The number of sub-pixels that will be combined to constitute a single pixel depends on the resolution of the display and on the operating current that is to be used. In general, even though the local electric field in the immediate vicinity of a microtip is in excess of 1 million volts/cm., the externally applied voltage is under a 100 volts. However, even a relatively low voltage of this order can obviously lead to catastrophic consequences, if short circuited.

The early prior art in this technology used external resistors, placed between the cathode or gate lines and the power supply, as ballast to limit the current in the event of a short circuit occurring somewhere within the display. While this approach protected the power supply, it could not discriminate between individual microtips or groups of microtips on a given cathode or gate line. Thus, in situations where one (or a small number) of the microtips is emitting more than its intended current, no limitation of its individual emission is possible. Such excessive emission can occur as a result of too small a radius of curvature for a particular microtip or the local presence of gas, particularly when a cold system is first turned on. Consequently the more recent art in this technology has taught ways of providing individual ballast resistors, either one per microtip or one per group of microtips.

A good example of the prior art is the approach taken by Meyer (U.S. Pat. No. 5,194,780 March 1993) as illustrated in FIG. 1. This shows, in plan view, a portion of a single cathode column which, instead of being a continuous sheet, has been formed into a mesh of lines 15 intersecting with lines 16. A resistive layer 17 has been interposed between the mesh and the substrate (not shown here). Microtips 12 have been formed on the resistive layer and located within the interstices of the mesh. A single gate line intersects the cathode line/mesh, and current from the mesh must first travel along resistive layer 17 before it reaches the microtips. A disadvantage of this approach is that the presence of the mesh limits the resolution of the display. Another disadvantage is that the ballast resistance value associated with any particular microtip can vary widely because of the geometry of this design.

A cross-sectional view of a somewhat larger portion of a Meyer style display is shown in FIG. 2. Buffer layer 21 sits atop substrate 22. Layer 27 is a resistive layer in which are embedded cathode columns 25. Gate lines 29 are separated from the cathode columns by dielectric layer 28 and are embedded in second resistive layer 23.

More recently, Kochanski (U.S. Pat. No. 5,283,500 Feb. 1, 1994) has described a variety of layout schemes which use a similar approach. Kochanski also teaches a method for ensuring that the ballast resistance associated with each of the various microtips is essentially the same. This is achieved by arranging the microtips in groups that are accessed by a symmetrical pattern of individual resistors, each of the same magnitude. Kochanski also uses a two impedance structure. The first impedance carries all the current associated with one or more intersecting regions. The second impedance is composed of a multiplicity of impedances each of which carries current from one or a few microtips at the given intersecting region(s). It is, however, not necessary to use this kind of two impedance structure.

From a cost standpoint the best design is that of Meyer. However, the problem remains that the value of the ballast resistance associated with any particular microtip can vary substantially from microtip to microtip. Recent studies have shown that the fraction of the microtips that are actually emitting in an arrangement similar to that described by Meyer is fewer than 9% and frequently is as low as 3%. This is believed to be due, at least in part, to this ballast non-uniformity problem. The present invention seeks to provide uniform ballast values while retaining the low cost features of the Meyer approach.

A pending application, ERSO-84-0029, unlike Kochanski's two impedance approach, has already addressed the problem by teaching that all the microtips in a given group are to be connected to an equipotential area which is, in turn, connected to a single ballast resistor. Two such devices are shown in schematic cross-section in FIG. 3. Microtips, such as 12, are in contact with equipotential area (conductive disk) 31 which lies on one end of resistor 32. Cathode columns 33 (running at right angles to the plane of the figure) lie on and connect to the other ends of resistors 32. Resistors, cathode columns, and equipotential areas are all covered by dielectric layer 34. Gate line 35 is deposited on top of layer 34 and openings, such as 36, are formed in it. Note that line 35 is conductive all the way from the openings 36 to the edge of the device. The openings extend through the dielectric layer down to the surface of equipotential area 31. A microtip 12 is centrally located inside each of the openings. A problem with this design is that although higher current densities are achieved because each microtip is associated with a ballast resistor of the same value, there is no resistor between the gate openings and the gate electrodes. Since, in FEDs, the gate current is much less than the cathode current, it is advantageous to have a resistor connected to the gate electrode. Moreover, in the same way that it is necessary that a uniform resistance value be associated with each microtip, it is also necessary that a uniform resistance value be associated with each gate. The present invention is directed towards including this feature in its design.

SUMMARY OF THE INVENTION

It is therefore an object of this invention to provide a cold cathode field emission display that includes separate ballast resistors for groups of field emitting microtips, said resistors being associated with both the cathodes and the gates.

Another object of the invention is that each member of a group of microtips receive the same amount of ballast resistance, independent of its position within the group.

Still another object of the invention is to provide a device that has minimum parasitic capacitance between the cathode and gate circuits.

Yet another object of the invention is to provide a method for manufacturing a device that satisfies the previous objects, at minimum cost.

These objects have been achieved by locating each group of microtips on a single conductive disk and interposing a reliable ballast resistor between each of these conductive disks and the cathode conductor. Additionally, a resistor, rather than a conductor, is used to connect the gate conductive disk to the gate electrode. The latter is arranged so as not to overlap with the cathode electrode.

BRIEF DESCRIPTION OF THE DRAWINGS

FIGS. 1 and 2 illustrate proposed designs in the prior art for providing ballast resistance for the microtips associated with a given pixel of the display.

FIG. 3 is a cross-section of a recently proposed design that overcomes some of the problems associated with the designs shown in FIGS. 1 and 2.

FIG. 4 shows a plan view of a pair of field emitting devices as embodied in the present invention.

DESCRIPTION OF THE PREFERRED EMBODIMENTS

Figure 5:
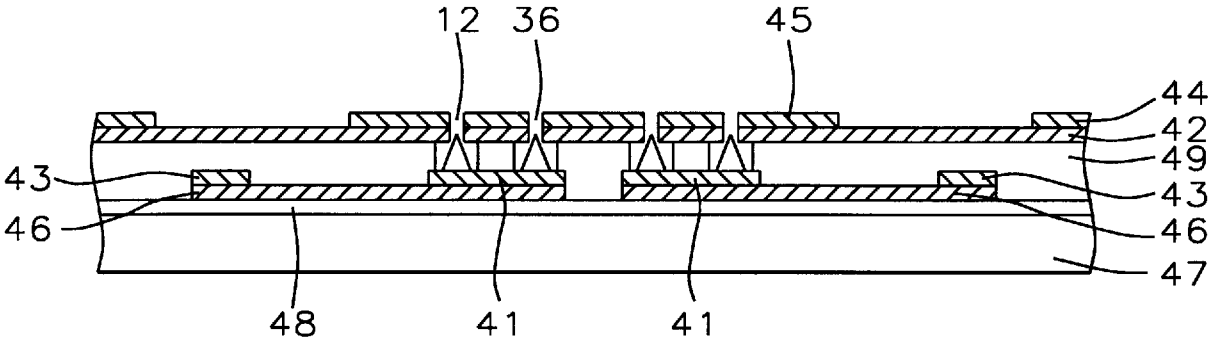
FIGS. 5 and 6 are two different possible cross-sectional views of FIG. 4, representing two different embodiments of the present invention.

Referring now to FIG, 4, we illustrate the principal features of the present invention by showing a plan view of a pair of devices. Two cathode conductive disks 41 are overlapped by a single gate conductive disk 45. The cathode conductive disks 41 connect to cathode conductor lines 43 through thin film resistors 46. The gate conductive disk 45 connects to the gate conductor electrode 44 through thin film resistor 42. Although we show resistor 46 as having a rectangular shape, it could also have other possible shapes such as, for example, serpentine. This would allow the use of resistive material having a lower sheet resistance and/or allow a lesser distance between the cathode conductive disk and the cathode conductor electrode.

A key feature of the present invention is that cathode conductor electrode 43 and gate conductor electrode 44 do not overlap one another. The gate conductor electrode makes electrical contact with the gate conductive disk through thin film resistor 42 which does overlap the cathode conductor electrode. Note, also, that, in the full display, cathode electrodes 43 and gate electrodes 44 will extend in both directions and be connected to cathode and gate electrodes from adjoining cells to form cathode columns and gate lines respectively. This implies that cathode and gate conductors do overlap, but the area of such overlap is much less than when the electrodes themselves are allowed to overlap as is the case in, for example, FIG. 3.

Referring now to FIG. 5, we show a cross-section taken through line 5—5 in FIG. 4. Insulating substrate 47 has been coated with adhesion enhancing buffer layer 48 which comprises silicon oxide or silicon nitride and is generally between about 1,000 and 10,000 Angstroms thick. Thin film cathode resistor 46 lies on the buffer layer. At one of its ends is cathode conductive disk 41 while cathode conductor electrode 43 is on the other end.

The thin film cathode resistor is composed of doped silicon or indium tin oxide (ITO) deposited to a thickness between about 1,000 and 10,000 Angstroms. It may be rectangular or serpentine in shape and will have a resistance value between about 1 and 200 megohms.

Dielectric layer 49, comprising silicon oxide or silicon nitride, covers cathode disk 41, cathode conductor electrode 43, and thin film resistor 46. Thin film gate resistor 42 lies on the top surface of dielectric layer 49 and is contacted by gate conductive disk 45 at one end and by gate conductor electrode 44 at its other end. Note that, as already discussed, the cathode and gate conductor electrodes do not overlap.

The thin film gate resistor is composed of doped silicon or ITO deposited to a thickness between about 1,000 and 10,000 Angstroms. It will have a resistance value between about 1 and 500 megohms.

Openings, such as 36, in gate conductive disk 45 extend through thin film gate resistor 42 as well as dielectric layer 49 to expose the surface of cathode conductive disk 41. Cone shaped field emission microtips, such as 12, are individually located inside these openings. The base of each microtip is in contact with cathode conductive disk 41 while its apex is in the same plane as gate conductive disk 45.

Figure 6:
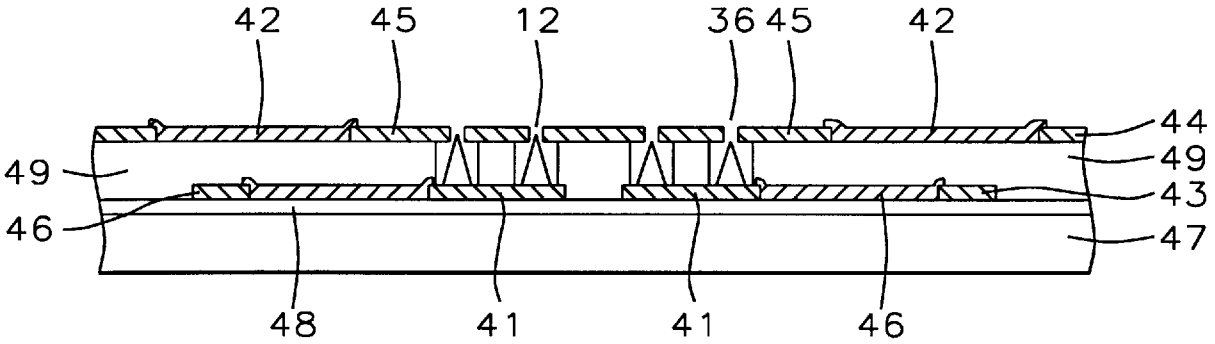

Referring now to FIG. 6, we show a second embodiment of the present invention. This is a cross-sectional view also taken at line 5—5 of FIG. 4. As in FIG. 5, insulating substrate 47 has been coated with buffer layer 48. Thin film cathode resistor 46 lies on buffer layer 48 but, unlike the embodiment shown in FIG. 5, cathode conductive disk 41 and cathode conductor electrode 43 also are in direct contact with layer 48. Resistor 46 serves to bridge the gap between them and makes contact with them by overlapping them at each of its ends.

The thin film cathode resistor is composed of doped silicon or ITO deposited to a thickness between about 1,000 and 10,000 Angstroms. It may be rectangular or serpentine in shape and will have a resistance value between about 1 and 200 megohms.

Dielectric layer 49 covers cathode disk 41, cathode conductor electrode 43, and thin film resistor 46. Thin film gate resistor 42 lies on the top surface of dielectric layer 49 but, unlike the embodiment shown in FIG. 5, gate conductive disk 45 and gate conductor electrode 44 also are in direct contact with layer 49. Resistor 42 bridges the gap between them and makes contact with them by overlapping them at each of its ends. In this embodiment the key feature of the invention, namely that the cathode and gate conductor electrodes do not overlap, can also be clearly seen.

Openings, such as 36, in gate conductive disk 45 extend through thin film gate resistor 42 as well as dielectric layer 49 to expose the surface of cathode conductive disk 41. Cone shaped field emission microtips, such as 12, are individually located inside these openings. The base of each microtip is in contact with cathode conductive disk 41 while its apex is in the same plane as gate conductive disk 45.

Continuing our reference to FIG. 6, we now describe methods for manufacturing the above-described embodiments. Starting with dielectric substrate 47, buffer layer 48 is deposited on to it. Then, a layer of conductive material, such as molybdenum or niobium is deposited and patterned, using standard photoresist and etching techniques, to form cathode conductive disk 41 and cathode conductor electrode 43. Then a layer of resistive material is deposited, patterned, and etched to form thin film cathode resistor 46 which bridges the gap between 41 and 43, overlapping 41 and 43 so as to make good contact to them.

This is followed by the deposition of dielectric layer 49, comprising silicon or silicon nitride to a thickness between about 0.1 and 1 microns, covering cathode disk 41, cathode conductor electrode 43, and resistor 46. Next, a second layer of conductive material is deposited onto dielectric layer 49 and patterned and etched to form gate conductive disk 45 and gate conductor electrode 44. A second resistive layer is then deposited, patterned and etched to form thin film gate resistor 42 which bridges the gap between gate conductive disk 45 and gate conductor electrode 44, overlapping each of them in order to make good electrical contact.

Openings are then made in gate conductive disk 45, extending through dielectric layer 49 to expose the surface of cathode conductive disk 41. Following this, cone shaped field emission microtips are formed inside the openings, one per opening. The base of each microtip is in contact with the cathode conductive disk while its apex is in the same plane as the gate conductive disk.

The process for manufacturing the embodiment shown in FIG. 5 is similar to that just described except that the resistive layers are laid down, and the resistors are formed, before their related conductive layers are deposited. The latter are then patterned to form conductive disks and conductive electrodes as before.

What is claimed is:

1. A field emission device comprising:

an insulating substrate;

a buffer layer, on said substrate;

a cathode conductive disk on said buffer layer;

a cathode conductor electrode on said buffer layer, separated from said cathode conductive disk by a first gap;

a thin film cathode resistor, bridging said first gap, and overlapping said cathode conductive disk and said cathode conductor electrode;

a dielectric layer, covering said cathode disk, said cathode conductor electrode, and said cathode resistor;

a gate conductive disk on said dielectric layer, overlapping said cathode conductive disk;

a gate conductor electrode, on said dielectric layer, separated from said gate conductive disk by a second gap and positioned so as not to overlap said cathode conductor electrode;

a thin film gate resistor, bridging said second gap, and overlapping said gate conductive disk and said gate conductor electrode;

openings in said gate conductive disk extending through said dielectric layer to the cathode conductive disk; and cone shaped field emission microtips, individually located inside said openings, a base of each conical microtip being in contact with said cathode conductive disk and an apex of each microtip being in the same plane as said gate conductive disk.

2. The field emission device of claim 1 wherein the resistors have a rectangular shape.

3. The field emission device of claim 1 wherein the resistors have a serpentine shape.

4. The field emission device of claim 1 wherein the resistance of each of the thin film cathode resistors is between about 1 megohm and 200 megohms.

5. The field emission device of claim 1 wherein the resistance of each of the thin film gate resistors is between about 1 megohm and 500 megohms.

6. The field emission device of claim 1 wherein said dielectric comprises material taken from the group consisting of silicon oxide, silicon nitride, and silicon oxynitride.

7. A cold cathode field emission display comprising:

a plurality of field emission devices, as described in claim 1, wherein the cathode conductive disks form a rectangular array having rows and columns;

cathode lines formed by connecting all cathode conductor electrodes that lie in the same column; and gate lines formed by connecting all gate conductor electrodes that lie in the same row.

8. A field emission device comprising:

an insulating substrate;

a buffer layer, on said substrate;

a thin film cathode resistor, having first and second ends, on said buffer layer;

a cathode conductive disk on said thin film cathode resistor located at said first end;

a cathode conductor electrode on said thin film cathode resistor located at said second end;

a dielectric layer, covering said cathode disk, said cathode conductor electrode, and said cathode thin film resistor;

a thin film gate resistor, having first and second edges, on said dielectric layer;

a gate conductive disk, on said thin film gate resistor, near said first edge and overlapping said cathode conductive disk;

a gate conductor electrode, on said thin film gate resistor, near said second edge and not overlapping said cathode conductor electrode;

openings in said gate conductive disk extending through said thin film gate resistor and said dielectric layer to the cathode conductive disk; and cone shaped field emission microtips, individually located inside said openings, a base of each microtip being in contact with said cathode conductive disk and an apex of each microtip being in the same plane as said gate conductive disk.

9. The field emission device of claim 7 wherein the resistors have a rectangular shape.

10. The field emission device of claim 8 wherein the resistance of each of the thin film cathode resistors is between about 1 megohm and 200 megohms.

11. The field emission device of claim 8 wherein the resistance of each of the thin film gate resistors is between about 1 megohm and 500 megohms.

12. The field emission device of claim 8 wherein said dielectric comprises material taken from the group consisting of silicon oxide, silicon nitride, and silicon oxynitride.

* * * * *